US007726874B2

(12) United States Patent
Kirchberg

(10) Patent No.: US 7,726,874 B2
(45) Date of Patent: Jun. 1, 2010

(54) METHOD AND DEVICE FOR DETERMINING THE CAPACITY OF A HEAT EXCHANGER

(75) Inventor: Karl-Heinz Kirchberg, Karlsruhe (DE)

(73) Assignee: Siemens Aktiengesellschaft, Munich (DE)

( * ) Notice: Subject to any disclaimer, the term of this patent is extended or adjusted under 35 U.S.C. 154(b) by 665 days.

(21) Appl. No.: 11/587,874

(22) PCT Filed: Apr. 29, 2005

(86) PCT No.: PCT/EP2005/004657

§ 371 (c)(1),
(2), (4) Date: Oct. 27, 2006

(87) PCT Pub. No.: WO2005/106375

PCT Pub. Date: Nov. 10, 2005

(65) Prior Publication Data

US 2008/0296010 A1 Dec. 4, 2008

(30) Foreign Application Priority Data

Apr. 30, 2004 (DE) ..... 10 2004 021 423

(51) Int. Cl.
*G01N 25/00* (2006.01)
*G01K 17/06* (2006.01)

(52) U.S. Cl. ..... 374/43; 374/29; 374/5; 374/57; 374/147; 374/40

(58) Field of Classification Search ..... 374/29–36, 374/39, 4, 5, 7, 43–45, 57, 110–112, 137, 374/141, 147–148, 165, 40
See application file for complete search history.

(56) References Cited

U.S. PATENT DOCUMENTS 3,350,671 A * 10/1967 Seamans, Jr. ..... 338/82
3,508,889 A * 4/1970 Epperly et al. ..... 48/214 A
3,593,578 A * 7/1971 Farrell et al. ..... 374/40
3,775,291 A * 11/1973 Sze ..... 208/57
3,871,444 A * 3/1975 Houser et al. ..... 165/101
3,918,300 A * 11/1975 Weisstuch et al. ..... 73/113.01
4,163,388 A * 8/1979 November ..... 374/37
4,224,825 A * 9/1980 Feller ..... 374/41
4,484,471 A * 11/1984 Swithenbank et al. .... 73/204.13

(Continued)

FOREIGN PATENT DOCUMENTS

DE 34 30 947 A1 3/1986

(Continued)

*Primary Examiner*—Gail Verbitsky

(57) ABSTRACT

A method and arrangement for determining the capacity of a heat exchanger is provided. The effective heat transfer coefficient for the heat exchanger is calculated from the measured inlet and outlet temperatures of the product and the measured inlet and outlet temperatures of the auxiliary medium. By means of the value, the outlet temperature of the product set for maximum flow of the auxiliary medium is determined as that at which the change in the heat content of the product is at least approximately the same as the change in the heat content of the auxiliary medium and the amount of heat transmitted by the heat exchanger for the product flow. The value is displayed to the user and permits a decision as to how much longer the heat exchanger can reliably be operated.

5 Claims, 1 Drawing Sheet

U.S. PATENT DOCUMENTS

| | | | | | |
|---|---|---|---|---|---|
| 4,766,553 | A | | 8/1988 | Kaya et al. | |
| 4,972,903 | A | * | 11/1990 | Kwok | 165/158 |
| 5,215,704 | A | * | 6/1993 | Hirota | 376/245 |
| 5,255,977 | A | * | 10/1993 | Eimer et al. | 374/41 |
| 5,363,905 | A | * | 11/1994 | Rhiel et al. | 165/279 |
| 5,429,178 | A | * | 7/1995 | Garey et al. | 165/11.1 |
| 5,615,733 | A | | 4/1997 | Yang | |
| 5,657,061 | A | * | 8/1997 | Seccombe et al. | 347/18 |
| 5,992,505 | A | * | 11/1999 | Moon | 165/11.1 |
| 6,678,628 | B2 | * | 1/2004 | Ryan et al. | 702/132 |
| 6,957,693 | B2 | * | 10/2005 | Smith | 165/134.1 |
| 2003/0075314 | A1 | | 4/2003 | Cryer et al. | |
| 2003/0139894 | A1 | * | 7/2003 | Ryan et al. | 702/132 |
| 2004/0057491 | A1 | * | 3/2004 | Stenestam | 374/29 |
| 2004/0240514 | A1 | * | 12/2004 | Bash et al. | 374/109 |
| 2006/0032606 | A1 | * | 2/2006 | Thybo et al. | 165/11.1 |
| 2006/0059924 | A1 | * | 3/2006 | Horan et al. | 62/129 |

FOREIGN PATENT DOCUMENTS

| | | | |
|---|---|---|---|
| EP | 0 155 826 | B1 | 12/1990 |
| JP | 57047199 | A | 3/1982 |
| WO | WO 82/01063 | A1 | 4/1982 |

* cited by examiner

METHOD AND DEVICE FOR DETERMINING THE CAPACITY OF A HEAT EXCHANGER

CROSS REFERENCE TO RELATED APPLICATIONS

This application is the US National Stage of International Application No. PCT/EP2005/004657, filed Apr. 29, 2005 and claims the benefit thereof. The International Application claims the benefits of German application No. 102004021423.9 DE filed Apr. 30, 2004, both of the applications are incorporated by reference herein in their entirety.

FIELD OF INVENTION

The invention relates to a method and a device for determining the capacity of a heat exchanger by means of which the temperature of a product flowing through the heat exchanger is to be changed with the aid of an auxiliary medium that serves as a cooling or heating medium.

BACKGROUND OF INVENTION

Heat exchangers of this type are frequently used in process-engineering installations alongside a plurality of different installation components such as, for example, machines, containers, chemical reactors, steam generators, columns or pumps. A heat exchanger is in principle a pipe through which a product that is to be cooled or heated by the surrounding medium, which is called the auxiliary medium, flows. Factors determining the capacity of the heat exchanger include as large as possible a heat-exchange area and as large as possible a heat transfer coefficient. Certain requirements for the heat exchanger emerge from the materials used, for example, the type of product and auxiliary medium, the necessary cooling or heating capacity, the cooling procedure used, structural conditions or legal regulations, for example with regard to cleaning. Because of the different requirements, many different forms of heat exchangers are widespread, for example, direct-current and counter-current heat exchangers, tube-bundle-type heat exchangers or plate-type heat exchangers.

A major problem in the operation of heat exchangers is what is known as fouling. Here, fouling is a collective term for contamination of all kinds. Fouling changes the heat transfer coefficient between the auxiliary medium which serves as a cooling or heating medium and the product. The consequences of this are that more cooling medium or heating medium is required as auxiliary medium, that the operating costs rise and/or that in the extreme case the desired temperature of the product can no longer be set by the heat exchanger. If this extreme case occurs, an unscheduled shutdown of the process-engineering installation in which the heat exchanger is used can be caused as a result. A common remedial measure is therefore a regular shutdown of production for the maintenance and cleaning of heat exchangers. However, this increases operating costs and restricts the availability of the installation.

SUMMARY OF INVENTION

An object of the invention is to create a method and a device that enable early detection of a decline in the capacity of a heat exchanger.

To achieve this object, a method and device are provided in the independent claims. Further developments of the invention are described in the dependent claims.

The invention has the advantage that the effects of changed heat transfer coefficients on the operation of the heat exchanger are determined and displayed in such a clear manner that they can even be interpreted correctly by non-specialists. The determined and displayed outlet temperature of the product which would be set for maximum flow of the auxiliary medium provides a particularly clear variable for the user, as the heat exchanger is being operated here at its capacity limit. It makes it clear how increasing fouling diminishes the adjustment range available. It is thus easy for the user to recognize whether and for how much longer the heat exchanger can set a desired temperature of a product and can continue to be operated trouble-free in a process-engineering installation. Unforeseen installation downtimes can thus largely be avoided.

A further development of the method has the advantage that the method for determining the outlet temperature of the product set for maximum flow of the auxiliary medium can be used in an arithmetically simple and easy manner for various types of heat exchangers.

In the further development, the arithmetic mean of the values of the outlet temperature of the product in the subset of value pairs can advantageously be calculated as a statistical criterion for selecting a value pair. In this way, a particularly simple, reliable and clear method for selection is applied.

A calculation and display of the standard deviation of the values of the outlet temperature of the product in the subset of value pairs has the advantage that evidence is obtained about the reliability of the result. The smaller the standard deviation the more meaningful the result for determining the capacity of the heat exchanger.

BRIEF DESCRIPTION OF THE DRAWINGS

The invention and embodiments and advantages are explained below in detail with the aid of the drawings, in which an exemplary embodiment of the invention is shown.

DETAILED DESCRIPTION OF INVENTION

There are heat exchangers of a wide variety of different designs, depending on the conditions in which they are used. The basic structure of a heat exchanger is shown in FIG. 1.

Figure 1:
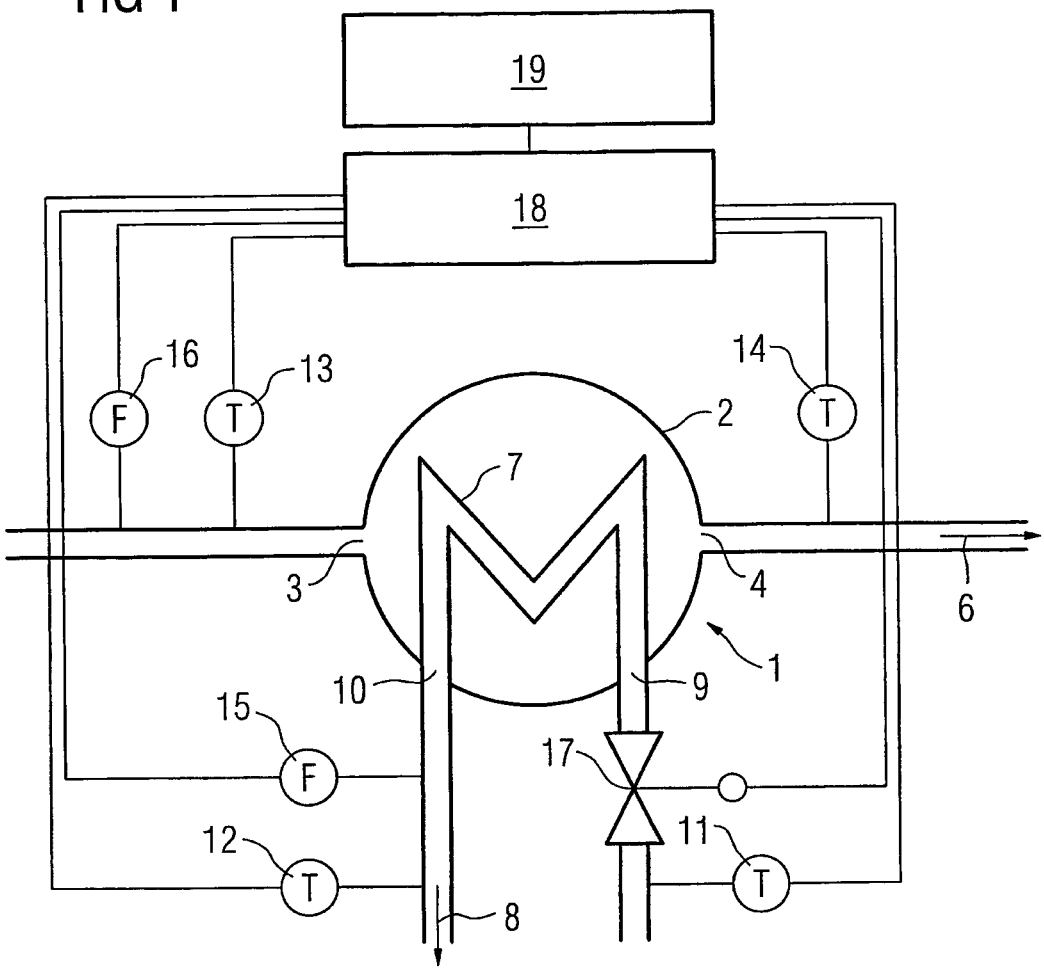
FIG. 1: shows a schematic diagram of a heat exchanger.

A heat exchanger 1 consists, in accordance with FIG. 1, of a container 2 into which a product flows through an inlet 3 and out of which it flows again through an outlet 4. The direction of flow of the product is marked by an arrow 6. Located in the container 2 is a coiled pipe 7 through which an auxiliary medium flows in the direction of an arrow 8. In the event of the product being cooled by the heat exchanger 1, cooling water, for example, flows through the pipe 7. The auxiliary medium enters the heat exchanger 1 by an inlet 9 and exits again by an outlet 10. The inlet temperature $\theta_{K,Ein}$ of the auxiliary medium is recorded by means of a temperature measuring transducer 11, and the outlet temperature $\theta_{K,Aus}$ by means of a temperature measuring transducer 12. Correspondingly, the inlet temperature $\theta_{W,Ein}$ of the product is measured by means of a temperature measuring transducer 13 and the outlet temperature $\theta_{W,Aus}$ by means of a temperature measuring transducer 14. Furthermore, to determine the flow $F_K$ of the auxiliary medium through the pipe 7 and the flow $F_W$ of the product through the container 2, flowmeters 15 and 16 are provided. By means of a regulating valve 17, the flow of the auxiliary medium can be adjusted such that a desired outlet temperature is set for the product. The regulating valve 17 receives an actuating signal from a control device 18 to which the measured values of the measuring transducers 11 . . . 16 are routed as input signals. Besides their function of calculating the position of the regulating valve 17 as a function of the measured values of the measuring transducers 11 . . . 16, the control device additionally has the function of an evaluation device which, to determine the capacity of the heat exchanger 1, determines the outlet temperature of the product set for maximum flow of the auxiliary medium. In a process-engineering installation, the control device 18 is implemented for example in an automation device which is linked via a data communication network to the measuring transducers 11 . . . 16 and the regulating valve 17. The determined outlet temperature and further values which are helpful in the assessment of the capacity of the heat exchanger 1 by a user, can then be displayed with the aid of a faceplate 19, i.e. by means of a display window for process visualization on an operating and monitoring console. If too sharp a reduction in the capacity of the heat exchanger 1 is displayed, the user can instigate suitable measures to eliminate the problem at a point in time before a desired outlet temperature of the product can no longer be set and thus before a correct flow of the process in which the heat exchanger is used would no longer be guaranteed.

The manner in which the capacity of the heat exchanger 1 is determined by the control device 18, which on account of its additional function is also called an evaluation device 18, will be explained below.

The outlet temperature $\theta_{W,Aus}$ of the product and the outlet temperature $\theta_{K,Aus}$ of the auxiliary medium can lie only in a defined range which is limited by the inlet temperature $\theta_{W,Ein}$ of the product and the inlet temperature $\theta_{K,Ein}$ of the auxiliary medium. If, for example, a product is to be cooled down, then the outlet temperature $\theta_{W,Aus}$ of the product cannot become less than the inlet temperature $\theta_{K,Ein}$ of the auxiliary medium. Likewise, the outlet temperature $\theta_{K,Aus}$ of a cooling medium cannot become greater than the inlet temperature $\theta_{W,Ein}$ of the product. The temperature range between the two inlet temperatures $\theta_{K,Ein}$ and $\theta_{W,Ein}$ in which values of the outlet temperatures $\theta_{K,Aus}$ and $\theta_{W,Aus}$ can physically meaningfully be set is, as it were, scanned for the calculation with the outlet temperatures $\theta_{K,Aus}$ and $\theta_{W,Aus}$ of the auxiliary medium and of the product, in that the two outlet temperatures are initially set to the inlet temperature $\theta_{K,Ein}$ of the auxiliary medium and then gradually increased up to the inlet temperature $\theta_{W,Ein}$ of the product. Expressed mathematically, this corresponds for example to n values $\theta_{K,Aus,i}$ with i=1 to n, where $\theta_{K,Aus,i}=\theta_{K,Ein}$ and $\theta_{K,Aus,n}=\theta_{W,Ein}$ or m values $\theta_{W,Aus,j}$ with j=1 to m, where $\theta_{W,Aus,l}=\theta_{K,Ein}$ and $\theta_{W,Aus,m}=\theta_{W,Ein}$ Or in a different notation:

$\theta_{K,Ein} \ldots \theta_{K,Aus,i} \ldots \theta_{W,Ein}$ $\theta_{K,Ein} \ldots \theta_{K,Aus,j} \ldots \theta_{W,Ein}$ Furthermore, all the pairs of values $(\theta_{K,Aus,i}, \theta_{W,Aus,j})$ of the two outlet temperatures are formed that are mathematically possible. In this way, a plurality of value pairs, namely n×m where i=1 to n and j=1 to m, are obtained which, based on the above consideration, are mathematically possible. For these value pairs, the amounts of heat transmitted at maximum flow of the auxiliary medium are calculated. The evaluation takes into account the fact that in the stationary condition, due to the energy balance being in equilibrium, a change $\dot{Q}_W$ in the energy content of the product is the same as a change $\dot{Q}_K$ in the energy content of the auxiliary medium and is the same as the amount of heat $\dot{Q}$ transmitted by the heat exchanger. The amount of heat transmitted is thus calculated in three different ways.

The change $\dot{Q}_W$ in the heat content of the product is calculated from the temperature difference between inlet temperature $\theta_{W,Ein}$ and outlet temperature $\theta_{W,Aus,j}$ of the product, the current mass flow $\dot{M}_{W,Aktuell}$ of the product and the specific heat $cp_W$ of the product:

$$\dot{Q}_W = cp_W \cdot \dot{m}_{W,Aktuell} \cdot (\theta_{W,Ein} - \theta_{W,Aus,j})$$

Here, the mass flow $m_{W,AAktuell}$ can be determined in a simple manner as the product of the flow $F_W$, measured by means of the flowmeter 16, and the density of the flowing product.

The change $\dot{Q}_K$ in the heat content of the auxiliary medium is calculated from the temperature difference between inlet temperature $\theta_{K,Ein}$ and outlet temperature $\theta K_{K,Aus,i}$ of the auxiliary medium, the maximum possible mass flow $\dot{m}_{K,Max}$ and the specific heat $cp_K$ of the auxiliary medium:

$$\dot{Q}_K = cp_K \cdot \dot{m}_{K,Max} \cdot (\theta_{K,Aus,i} - \theta_{K,Ein}).$$

To calculate the quantity of heat transmitted, firstly the currently effective heat transfer coefficient $k_{wirk}$ is determined from the current measured values of the measuring transducers 11 . . . 16. The following equation applies to the example of a counter-current heat exchanger:

$$k_{wirk} = \frac{cp_W \cdot \delta_W \cdot F_W \cdot (\vartheta_{W,Ein} - \vartheta_{W,Aus})}{A \cdot \frac{\Delta\vartheta_a - \Delta\vartheta_b}{\ln\frac{\Delta\vartheta_a}{\Delta\vartheta_b}}}$$

with $\Delta\theta_a = \theta_{W,Ein} - \theta_{K,Aus}$ and $\Delta\theta_b = \theta_{W,Aus} - \theta_{K,Ein}$.

Here, A denotes the effective exchange area of the heat exchanger and $\delta_W$ the specific density of the product.

This equation applies in cases where the variables are not temperature-dependent or pressure-dependent. Otherwise, this can be taken into account in the calculation to increase accuracy.

The amount of heat transmitted $\dot{Q}$ is calculated from the mean temperature difference between product and auxiliary medium, the heat transfer coefficient $k_{wirk}$ and the effective exchange area A according to the following equation:

$$\dot{Q} = k \cdot A \cdot \Delta\vartheta_{ln} \text{ with } \Delta\vartheta_{ln} = \frac{\Delta\vartheta_a - \Delta\vartheta_b}{\ln\frac{\Delta\vartheta_a}{\Delta\vartheta_b}}$$

whereby for the mean temperature difference in the case of a counter-current heat exchanger:

$$\Delta\theta_a = \Delta\theta_{W,Ein} - \theta_{K,Aus} \text{ and } \Delta\theta_b = \Delta\theta_{W,Aus} - \theta_{K,Ein}$$

is used, and for the mean temperature difference in a direct-current heat exchanger:

$$\Delta\theta_a = \Delta\theta_{W,Ein} - \theta_{K,Ein} \text{ and } \Delta\theta_b = \Delta\theta_{W,Aus} - \theta_{K,Aus}.$$

Once the three transmitted amounts of heat $\dot{Q}_W$, $\dot{Q}_K$ and $\dot{Q}$ have been calculated for each of the value pairs, those value pairs are sorted out which, based on a comparison of amounts of heat, are physically appropriate. In the stationary condition, the three calculated amounts of energy must be equal in magnitude. This means in cases of cooling that the change $\dot{Q}_W$ in the heat content of the product must, through heat transfer $\dot{Q}$, produce a corresponding change $\dot{Q}_K$ in the heat content of the auxiliary medium. Due to measurement errors and simplifications in the calculation, a certain tolerance has to be allowed for in the calculated values:

$$\dot{Q}_K \approx Q_W \approx \dot{Q}.$$

This equation can basically be solved analytically. It is, however, more easily and simply transferable to other forms of heat exchangers to determine a subset from the plurality of value pairs in which the calculated values lie within a predeterminable tolerance using the calculated changes in heat contents and the calculated value of the amount of heat transmitted. The last-mentioned equation thus corresponds to a "filter" by means of which the physically appropriate value pairs can be sorted out as a subset from the plurality of mathematically possible value pairs.

Where there is a broad predetermined tolerance, the subset of value pairs is correspondingly larger so that it is advantageous to select using a statistical method a value pair which is highly probable to contain the outlet temperatures set for maximum flow of the auxiliary medium. As a particularly simple statistical method, the arithmetic mean of the values of outlet temperatures of the product which are contained in the value pairs of the subset is calculated for this purpose. To assess the accuracy of this result, the standard deviation of the values of the outlet temperatures of the product is determined from this subset as well as the minimum value and the maximum value of the outlet temperature of the product. If these values are relatively large, this indicates a comparatively inaccurate result. Where the standard deviation is relatively small or where the minimum and maximum value lie close together, it can be assumed that the accuracy of the result is good.

Figure 2:
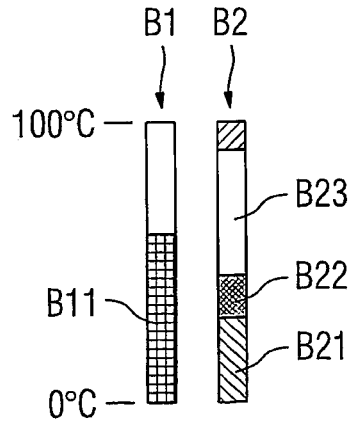
FIG. 2: shows a display for illustrating the capacity of a heat exchanger.

In order to enable a particularly simple assessment of the results by a user, these can be displayed on a faceplate as shown in FIG. 2, for example on an operating and monitoring console of a process-engineering installation. A bar on the left B1 shows via the height of a bar segment B11 the currently measured actual value of the outlet temperature $\theta_{W,Aus}$, which in the example shown lies at approximately 60° C. The range of values starts at the lower end of the bar and ends at the upper end at 100° C. To the right of this bar B1 is a second bar B2 with the aid of which the capacity of the heat exchanger can be assessed by the user in a simple manner. The range of values of bar B2 matches that of bar B1. The height of a lower segment of the bar B21 shows the minimum possible outlet temperature $\theta_{W,Aus,Neu}$ of the product when the condition of the heat exchanger is new. When the condition of the heat exchanger was new, this was calculated with the aid of the effective heat transfer coefficient measured at this time and stored. In the example, this temperature lies at 31.5° C. A segment of the bar B22 lying above this shows by its height the reduction in the capacity of the heat exchanger that has already occurred as a result of fouling. The currently calculated value of the minimum possible outlet temperature $\theta_{W,Aus,Neu}$ stands in this example at 44.5° C. and thus due to fouling already lies 13° C. above the corresponding outlet temperature for the heat exchanger when new. A further segment of the bar B23 shows at its upper end the inlet temperature $\theta_{W,Ein}$ of the product, which is currently measured at 90° C. The segment of the bar B23 thus corresponds to the adjustment range of the heat exchanger. The height difference between the upper limit of bar segment B11 and the upper limit of bar segment B22 which in the example shown totals 15.8° C., shows how large a remaining correcting range is relative to the currently existing outlet temperature $\theta_{W,Aus,Aktuell}$ of the product. In this way, even a user without particular know-how can assess for how much longer the heat exchanger can reliably continue to be operated. In order to make it possible for the values to be read off accurately on the faceplate, said values are in practice of course also displayed numerically. These numerical displays are, for reasons of clarity, not shown in FIG. 2. In order to enable an estimation to be made of the accuracy of the calculations, the standard deviation and the minimum and maximum value determined in the manner described previously, the number of value pairs on which the calculation was based, as well as the number of value pairs in the subset for which the calculated changes in heat content lie within the predetermined tolerance band, can also be displayed numerically.

The changes in heat content are calculated only for the heat exchanger in a stationary condition. That has the advantage that only equations for mass and energy balances in a state of equilibrium have to be used. Consequently, no further-reaching and considerably more complex physical model, with which the dynamic behavior of the process could be simulated, are needed. This advantageously enables a comparatively simple calculation to be made of the outlet temperature $\theta_{W,Aus,Min}$ of the product set for maximum flow of the auxiliary medium.

The invention claimed is:

1. A method for determining a cooling capacity of a heat exchanger, comprising:

measuring an inlet temperature and an outlet temperature of the product whose temperature is to be changed by the heat exchanger;

measuring an inlet temperature and an outlet temperature of the auxiliary medium that serves as a cooling or heating medium during operation of the heat exchanger in an at least minimum flow condition;

calculating a heat transfer coefficient of the heat exchanger as a function of the measured temperature values;

determining that a change in the heat content of the product, a change in the heat content of the auxiliary medium, and an amount of heat transmitted by the heat exchanger, determined with the calculated heat transfer coefficient, are in a relationship within a defined range from which a change in capacity is identified; and displaying the change in capacity in a unit of temperature to determine a level of fouling within the heat exchanger, wherein to determine that a change in the heat content of the product, a change in the heat content of the auxiliary medium, and an amount of heat transmitted by the heat exchanger are in a relationship within a defined range the changes determined with a plurality of value pairs ($\theta_{K,Aus,i}$, $\theta_{W,Aus,j}$), where $\theta_{K,Aus,i}$ is an empirical value of the outlet temperature of the auxiliary medium, which value lies between the measured inlet temperature of the auxiliary medium and the measured inlet temperature of the product, and where $\theta_{K,Aus,j}$ is an empirical value of the outlet temperature of the product, which value lies between the measured inlet temperature of the auxiliary medium and the measured inlet temperature of the product, the change $\dot{Q}_K$ in the heat content of the auxiliary medium, the change $\dot{Q}_W$ Q in the heat content of the product and the amount of heat $\dot{Q}$ which can be transmitted by the heat exchanger having the calculated heat transfer coefficient are calculated, in that from the plurality of value pairs a subset of value pairs is determined for which the two calculated values of the changes in heat content $\dot{Q}_K$ and $\dot{Q}_W$ and the calculated value of the quantity of heat $\dot{Q}$ which can be transmitted differ by less than a predeterminable threshold value and in that, in accordance with a predeterminable statistical criterion, from the subset a value pair is selected having the value to be displayed of the set outlet temperature of the product.

2. The method according to claim 1, wherein a standard deviation of the values of the outlet temperature of the product in the subset of value pairs is calculated and displayed.

3. The method according to claim 1, wherein as a statistical criterion for the selection of a value pair, the arithmetic mean of the values of the outlet temperature of the product in the subset of value pairs is calculated.

4. The method according to claim 3, wherein a standard deviation of the values of the outlet temperature of the product in the subset of value pairs is calculated and displayed.

5. A device for determining a cooling capacity of a heat exchanger, comprising:

a plurality of temperature measuring transducers effective to measure:

an inlet temperature of a product to be changed by the heat exchanger, an outlet temperature of the product, an inlet temperature of the auxiliary medium effective to change the product temperature, an outlet temperature of the auxiliary medium, in an at least minimum flow condition;

an evaluation device effective for calculating a heat transfer coefficient of the heat exchanger as a function of the temperature values and effective for determining that a change in the heat content of the product, a change in the heat content of the auxiliary medium, and an amount of heat transmitted by the heat exchanger, determined with the calculated heat transfer coefficient, are in a relationship within a defined range from which a change in capacity is identified; and a display device effective to display the change in capacity in a unit of temperature to determine a level of fouling within the heat exchanger, wherein the evaluation device determines, with a plurality of value pairs, ($\theta_{K,Aus,i}$, $\theta_{W,Aus,j}$), that a change in the heat content of the product, a change in the heat content of the auxiliary medium, and an amount of heat transmitted by the heat exchanger are in a relationship within a defined range, where $\theta_{K,Aus,i}$ is an empirical value of the outlet temperature of the auxiliary medium, which value lies between the measured inlet temperature of the auxiliary medium and the measured inlet temperature of the product, and where $\theta_{W,Aus,j}$ is an empirical value of the outlet temperature of the product, which value lies between the measured inlet temperature of the auxiliary medium and the measured inlet temperature of the product, the change $\dot{Q}_K$ in the heat content of the auxiliary medium, the change $\dot{Q}_W$ in the heat content of the product and the amount of heat $\dot{Q}$ which can be transmitted by the heat exchanger having the calculated heat transfer coefficient are calculated, in that from the plurality of value pairs a subset of value pairs is determined for which the two calculated values of the changes in heat content $\dot{Q}_K$ and $\dot{Q}_W$ and the calculated value of the quantity of heat $\dot{Q}$ which can be transmitted differ by less than a predeterminable threshold value and in that, in accordance with a predeterminable statistical criterion, from the subset a value pair is selected having the value to be displayed of the set outlet temperature of the product.

* * * * *